United States Patent [19]

Hedström et al.

[11] Patent Number: 4,738,762

[45] Date of Patent: Apr. 19, 1988

[54] ELECTROWINNING SYSTEM

[75] Inventors: Lars Å. Hedström, Ursviken; Kenneth A. S. Sjöberg, Boliden, both of Sweden

[73] Assignee: Boliden Aktiebolag, Stockholm, Sweden

[21] Appl. No.: 903,722

[22] Filed: Sep. 5, 1986

[30] Foreign Application Priority Data

Sep. 16, 1985 [SE] Sweden ..... 8504290

[51] Int. Cl.[4] ..... C25C 5/02; C25C 7/00

[52] U.S. Cl. ..... 204/235; 204/257; 204/258; 204/261; 204/273

[58] Field of Search ..... 204/233–235, 204/257–258, 260–266, 107–108, 113, 117, 119, 122, 273, 240, 276, 278

[56] References Cited

U.S. PATENT DOCUMENTS

| | | | |
|---|---|---|---|
| 893,472 | 7/1908 | Forget | 204/261 |
| 1,456,784 | 5/1923 | Christensen | 204/117 |
| 3,737,381 | 6/1973 | White et al. | 204/233 X |
| 4,181,588 | 1/1980 | Wong et al. | 204/115 |
| 4,204,922 | 5/1980 | Fraser et al. | 204/261 X |
| 4,312,724 | 1/1982 | Kammel et al. | 204/117 |

FOREIGN PATENT DOCUMENTS

| | | |
|---|---|---|
| WO8402356 | 6/1984 | PCT Int'l Appl. . |
| 1427228 | 3/1976 | United Kingdom . |

*Primary Examiner*—Donald R. Valentine

*Attorney, Agent, or Firm*—Burns, Doane, Swecker & Mathis

[57] ABSTRACT

The invention relates to an electrowinning cell for extracting metals in powder form from solutions, and simultaneously oxidizing the solution. The cell is characterized by radially extending electrodes comprising mutually alternating anodes and cathodes; by a diaphragm which delimits separate anode and cathode chambers, of which the cathode chamber forms an outer space; and a stirring means arranged in the anode chamber and operative to ensure a large flow of electrolyte across the anode surfaces. The base of the cathode chamber is preferably conical in shape.

10 Claims, 3 Drawing Sheets

ELECTROWINNING SYSTEM

This invention relates to an electrowinning cell for extracting metal in powder form from solutions while simultaneously oxidizing the solution.

The hydrometallurgical extraction of metals from concentrates and other metal starting materials is often carried out in a two-stage process, of which the first stage is an oxidizing leaching stage and the second stage comprises the electrolytic extraction of metal from the solution, so-called electrowinning. The starting material is mixed with a leaching liquor, wherewith the metal content of the material dissolves in the leaching liquor. The starting material may be a sulphidic metal concentrate, a metal dust, metal ash, or a metal alloy. A normal leaching liquor in this regard is chloride solution, although it is also known to use sulphate solutions and other solutions. The leaching liquor shall also contain a metal ion that is capable of being present in the liquor in at least two states of valency, e.g. $Fe^{2+}/Fe^{3+}$, $Cu^{+}/Cu^{2+}$. The metal ions constitute an oxidation agent during the leaching process, and consequently the metal ions present in the solution must be in an oxidized state, i.e. have a valency which is higher than the lowest valency for the metal ions. The metal ion is reduced to a lower valency during the oxidative leaching. A clear solution is taken from the leaching stage and passed to the electrowinning cell. The metal leached from the starting materials is precipitated out in powder form in the cell, while the metal ions chemically reduced in the leaching stage are oxidized, at the same time, to the higher valency state. The leaching liquor is recirculated to the leaching stage.

One problem encountered with electrowinning processes is that it is necessary to restrict the anodic current density to levels at which the risk of oxygen-gas and chlorine-gas generation in a chloride environment is negated. Problems occur in sulphate environments due to the rise in voltage caused by poor circulation (electrolyte movement) in the cell, which in addition to resulting in higher electrical current consumption also shortens the useful life of the anode. Another problem associated with cells hitherto used is one of enabling the cathode products to be removed from the cell in a simple and, above all, operationally reliable manner.

Consequently there is a general desire for a cell which will enable the application of higher anodic current densities for use solely for oxidizing metal ions, therewith to avoid the generation of chlorine gas and oxygen gas, and for a cell from which the resultant metal product can be removed in a simple and operationally reliable manner.

The objective of the present invention is to provide an electrowinning cell which will fulfill the aforesaid desideratum, at least to a high degree. The characterizing features of the invention are set forth in the following claims.

The cell according to the invention thus comprises separate anode and cathode chambers, delimited by means of a diaphragm. The cathode chamber surrounds the anode chamber. When using the cell, leaching liquor is delivered first to the cathode chamber, where metal powder precipitates onto the cathodes, whereafter the liquor is caused to flow to the anode chamber, where the liquor is oxidized and leaves the cell, preferably via a spillway located in the anode chamber.

The arrangement of radially extending electrodes is known in association with a cell intended for simultaneous leaching and electrowinning processes, as described and illustrated for example in WO84/02356. The advantages which can be gained by using radial electrode arrays in an electrowinning cell for extracting metal from leaching solutions supplied thereto have not previously been disclosed, or even indicated, however. Thus, there is obtained a substantially simpler and far less expensive construction in comparison with traditional rectangular cells provided with alternate anode and cathode elements. The requisite circulation of electrolyte over the anode surfaces can be sustained readily with the aid of the centrally positioned stirring device. Rectangular cell constructions require the provision of an external circulation pump with pipes and distribution box. In addition to the more expensive and more complicated equipment required with known rectangular cells, the current resistance is also much higher than that of the cell according to the present invention, which means that a higher power input is required in order to achieve the requisite circulation of the electrolyte.

The electrowinning cell will now be described in more detail with reference to the accompanying drawing and to a number of working examples.

Figure 1:
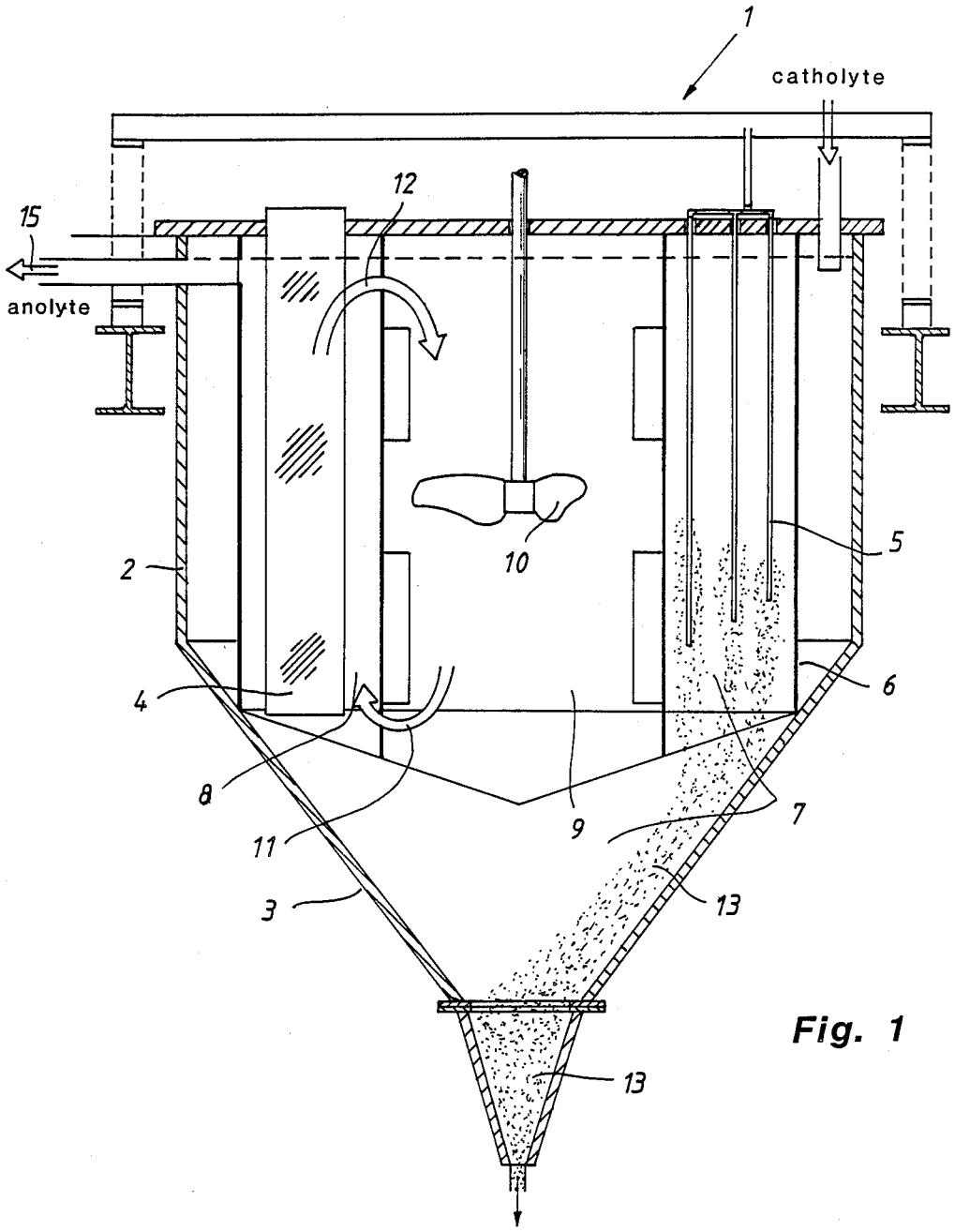
FIG. 1 is a vertical sectional view of an electrowinning cell generally designated 1.

The cell 1 comprises a vessel 2 having a conical base 3. The cell 1 has extending radially therein a plurality of mutually alternating anodes 4 and cathodes 5. A diaphragm having a diaphragm support 6 is arranged between the electrodes, such as to delimit a cathode chamber 7, which is in direct communication with the base 3 of the vessel 2, and an anode chamber 8 which communicates with a centrally located space 9 having a stirring device 10 arranged therein, said stirring device being operative to ensure effect circulation of the electrolyte.

The electrolyte located in the anode chamber 8 and the central space 9 is designated anolyte, whereas the electrolyte present in the cathode chamber 8 is designated catholyte. The stirring device 10 causes the anolyte to circulate through the central space 9 to the anode chamber 8, as shown by the arrow 11, and thereafter along the anodes 4 and back to the central space 9, as indicated by the arrow 12.

Figure 3:
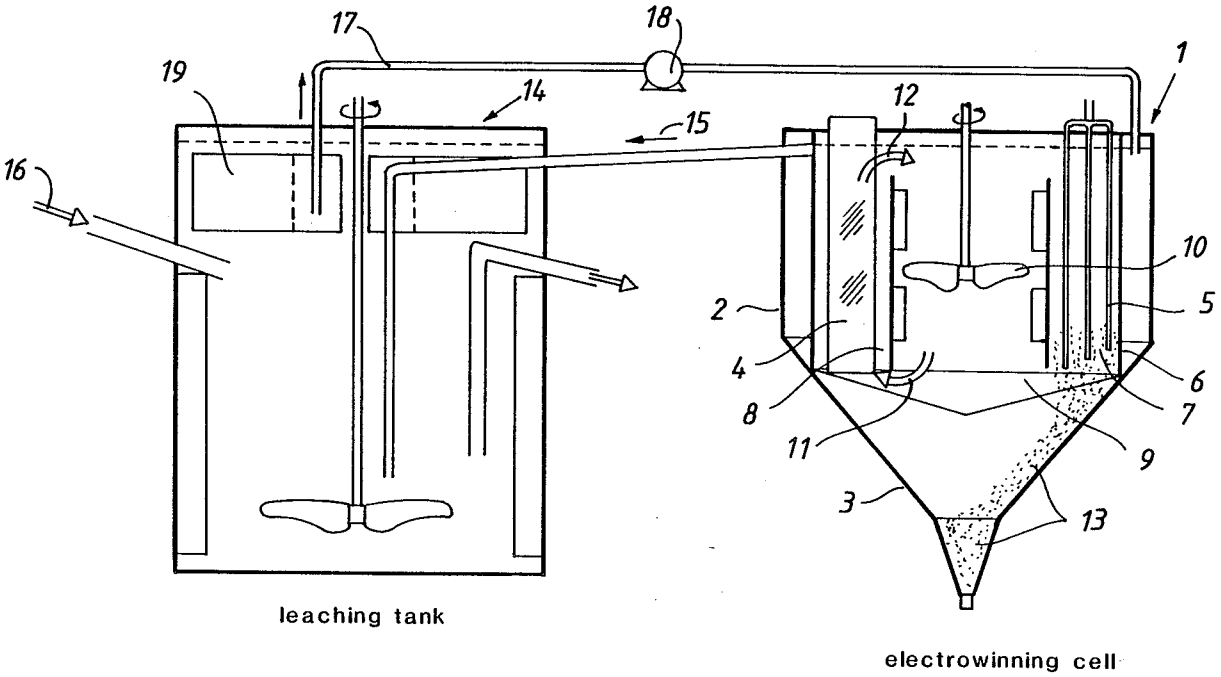
FIG. 3 illustrates an apparatus lay-out incorporating a leaching tank in combination with the cell illustrated in FIGS. 1 and 2.

The catholyte is delivered from the leaching process to the cathode chamber 7, where the leached metal is chemically reduced and precipitated onto the cathodes 5, from where the metal falls in the form of a fine powder 13, and collects on the conical base 3, from where the powdered product is removed through a bottom-outlet, as indicated at 14, for example by suction or by suitable mechancial means. Starting material 16 is mixed in the tank with oxidized leaching liquor 15. Clear solution 17 is removed via a filter 19 and is pumped to the cell 1 by pump 18. As illustrated in FIG. 3, the electrolytic cell can be connected to a leaching tank generally identified by reference number 14, in which incoming starting material 16 is mixed with oxidized leaching liquor 15, whereupon the metal in the starting material passes into solution. Leaching solution 17 containing chemically reduced metal is removed by suction from the upper part of the leaching tank 14 and passed to the cell 1, via a pump 18 and a filter means 19. This leaching solution 17 constitutes the catholyte in the electrolytic cell 1. Metal powder 13 is precipitated onto the cathodes 5, whereafter the catholyte flows into the anode chamber 8, via the diaphragm 6, and now constitutes the anolyte. The chemically reduced metal-ion content of the anolyte is oxidized more or less completely by the anodes 4 and is, in turn, utilized in the leaching tank 14 for leaching purposes.

This simple agitation of the electrolyte causes the flow over the anode surfaces to be so effective that solely oxidation of metal ions takes place, in the absence of chlorine gas or oxygen gas generation, even at high current densities. Transportation of the metal powder from the cell 1 is also carried out in such a simple and efficient manner as to practically exclude the risk of stoppages with regard to the outfeed of said metal powder.

The cell according to the invention can be used for various known purposes within the electrowinning technique. Two fundamentally different processes in which the cell according to the invention can be used to advantage fare described by way of example in this regard.

A. Leaching of sulphidic concentrate, in which sulphide is converted to elementary sulphur which remains in the leaching residue and the metal content of the concentrate passes more or less completely into solution.

B. Leaching of pulverized metallic products, e.g. an alloy, in which the metal content is oxidized and passes into solution.

In these cases either all metals pass into solution, or alternatively only a given metal passes into solution and the remaining metals remain in a leaching residue.

Processes concerned with the recovery of copper, lead, or silver can be mentioned in the case of A. When copper is present in chalcopyrite, iron will also be dissolved. The iron can be conveniently precipitated out as FeOOH while blowing air into the leaching stage. In doing so, the copper ions which have been chemically reduced during the iron leaching process will also return to the oxidized state. The system can therewith be said to obtain an electron balance.

When recovering copper, an advantage is gained when the metal ion which is reduced and oxidized is also copper. In this case approximately only half the copper present in the cathode chamber of the cell is precipitated out, in order for there to be sufficient copper for oxidation in the anode chamber.

When recovering lead, an advantage is gained when the oxidized and chemically reduced metal ion is iron. In this case all the lead present can be precipitated out in the cathode chamber, none is needed for the anode reaction. When recovering lead the leaching process can be carried out under oxidizing conditions so weak as to enable lead to be leached selectively from a lead/zinc/copper concentrate.

Figure 2:
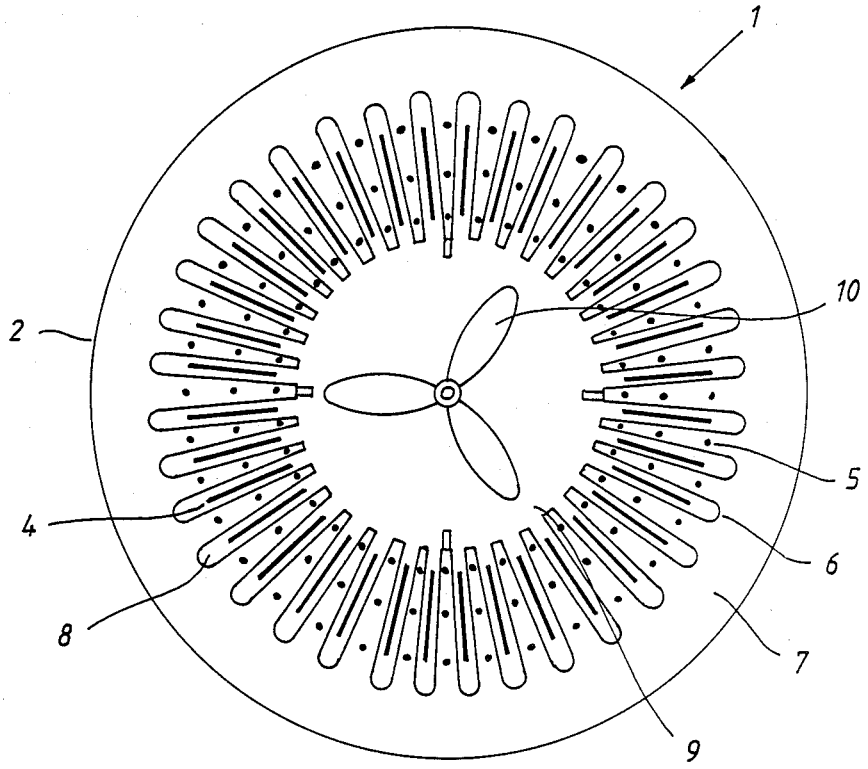
FIG. 2 is a top plan view of the cell illustrated in FIG. 1.

EXAMPLE 17.5 kg of sulphidic copper-lead concentrate containing, inter alia, 23.7% Cu, 24.6% Fe, 6.7% Zn and 6.6% Pb, was slurried with chloride solution in a leaching tank of the kind illustrated in FIG. 3, to form 48 liters of suspension. The leaching tank was connected, via a filter device and a pump, to an electroytic cell of the kind illustrated in FIGS. 1 and 2. The tanks accommodated in total 50 liters of solution. The anodic current density was maintained at 250 $A/m^2$ and a current of 50 A. The solution contained 250 g/l NaCl and during the test run had a low pH of about 1.5 and a temperature of 90° C. The total cell voltage was 2.0 V, of which about 0.2 V was cathodic and 0.8 V anodic, the remaining 1.0 V constituting the voltage loss in electrolyte and diaphragm. The results are given in the following Tables.

TABLE 1

| Summary of solution analyses | | | | | |
|---|---|---|---|---|---|
| Time, hr | Cu, mg/l | Zn, g/l | Fe, g/l | Pb, g/l | |
| 0 | 7 | 2.8 | 7.7 | 16.7 | catholyte |
| 1.5 | 7 | 2.8 | 7.6 | 16.0 | catholyte |
| 3 | 7 | 2.7 | 7.3 | 15.2 | catholyte |
| 4.5 | 6 | 2.9 | 7.4 | 14.5 | catholyte |
| 6 | 35 | 3.1 | 7.6 | 14.3 | catholyte |
| 6 | 22 | 3.0 | 7.8* | 13.5 | anolyte |

TABLE 2

| Summary of leaching analyses | | | | |
|---|---|---|---|---|
| Time, hr | Cu, % | Zn, % | Fe, % | Pb, % |
| 0 | 23.7 | 6.7 | 24.6 | 6.6 |
| 0** | 24.2 | 7.1 | 25.1 | 5.1 |
| 1.5 | 24.9 | 7.2 | 25.7 | 2.9 |
| 3 | 25.1 | 7.3 | 25.9 | 1.4 |
| 4.5 | 25.5 | 7.3 | 26.1 | 0.7 |
| 6*** | 25.7 | 7.3 | 26.3 | 0.2 |

TABLE 3

| Summary of lead product analyses | | | | | |
|---|---|---|---|---|---|
| Pb, % | Cu, % | Zn, % | Fe, % | Ag, % | Cl, % |
| 99.6 | 0:07 | 0.03 | 0.05 | 0.10 | 0.15 |

*The circulation of solution between leaching tank and electrolytic cell was maintained at a level such that about one-third of the iron present in the anolyte was in trivalent form and about two-thirds in divalent form.

**Part of the lead mineral had a form in which it dissolved when mixed with the chloride-containing solution.

***Continuous measurement of the redox potential indicated that the leaching process was completed in as little time as from 5 hours to 5 hours 30 minutes.

We claim:

1. An electrowinning system for extracting metals in powder form from a solution while simultaneously oxidizing the solution comprising:

(a) an electrowinning cell comprised of (i) a plurality of radially arranged electrodes with alternate anodes and cathodes, (ii) a diaphragm which forms separate anode and cathode chambers, said cathode chamber being formed in an outer portion of the electrowinning cell and surrounding the anode chamber which is located in an inner portion of the electrowinning cell, said cathode chamber further having a conical base and being provided with an inlet for fresh electrolyte and said anode chamber being provided with an outlet for removing oxidized anolyte, and (iii) stirring means arranged in the anode chamber and operative to ensure a large flow of electrolyte over the surfaces of the anodes; and (b) a separate leaching tank which is connected to and receives oxidized anolyte from the outlet of the anode chamber and which is connected to and provides fresh catholyte to the cathode chamber.

2. The system of claim 1 wherein the conical base is provided with means for removing metal in powder form.

3. The system of claim 2 wherein the removing means comprises means for suction discharge.

4. The system of claim 2 wherein the removing means comprises means for mechanical discharge.

5. The system of claim 1 wherein the stirring means is arranged above the bottoms of the anodes.

6. The system of claim 5 wherein the stirring means is arranged above the bottoms of the cathodes.

7. The system of claim 1 wherein the fresh catholyte is provided from the upper portion of the leaching tank.

8. The system of claim 7 wherein the fresh catholyte is passed through filter means located in the leaching tank.

9. The system of claim 8 wherein the leaching tank is provided with a stirring device.

10. The system of claim 9 wherein the stirring device is located in the lower portion of the leaching tank.

* * * * *